US009138078B2

(12) United States Patent
Barkdoll et al.

(10) Patent No.: US 9,138,078 B2
(45) Date of Patent: Sep. 22, 2015

(54) RETAIL MERCHANDISE HANGER WITH MOUNTING CLIP

(75) Inventors: Patrick J. Barkdoll, Pecatonica, IL (US); Stanley C. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 1480 days.

(21) Appl. No.: 12/424,254

(22) Filed: Apr. 15, 2009

(65) Prior Publication Data

US 2010/0264102 A1 Oct. 21, 2010

(51) Int. Cl.
*A47F 5/08* (2006.01)

(52) U.S. Cl.
CPC ..... *A47F 5/0823* (2013.01)

(58) Field of Classification Search
CPC ... A47F 5/0823; A47F 5/0815; A47F 5/0807; A47F 5/0846; A47F 5/0869; A47F 5/0876; A47B 57/52; A47B 57/30; A47B 96/061; A47B 96/068
USPC ..... 211/54.1, 57.1, 59.1, 7, 94.01; 248/220.21, 220.31, 220.41, 220.42, 248/220.43, 221.11, 221.12
See application file for complete search history.

(56) References Cited

U.S. PATENT DOCUMENTS

| | | | | |
|---|---|---|---|---|
| 1,411,065 | A * | 3/1922 | Reynolds | 24/3.8 |
| 2,097,419 | A * | 10/1937 | Schmidt | 359/602 |
| 2,477,735 | A * | 8/1949 | Gentile | 248/220.31 |
| 2,498,842 | A | 2/1950 | Kuenne | |
| 2,673,889 | A * | 3/1954 | Metz | 174/138 J |
| 2,927,956 | A | 3/1960 | Reisch | |
| 3,180,606 | A | 4/1965 | Sabin et al. | |
| 3,252,678 | A | 5/1966 | Myers et al. | |
| 3,273,844 | A | 9/1966 | Hodson et al. | |
| 3,409,260 | A | 11/1968 | Bleed | |
| 3,516,552 | A | 6/1970 | Salava | |
| 3,628,762 | A | 12/1971 | Williams | |
| 3,848,843 | A | 11/1974 | Levy | |
| 3,854,639 | A * | 12/1974 | Genchi | 224/234 |
| 3,912,212 | A | 10/1975 | Betts, Sr. | |
| 3,944,176 | A | 3/1976 | Danko | |
| 3,954,243 | A | 5/1976 | Sharp et al. | |
| 4,026,508 | A | 5/1977 | Ziegler | |
| 4,103,854 | A | 8/1978 | Pliml et al. | |
| 4,154,356 | A * | 5/1979 | Schieve | 220/480 |
| 4,319,531 | A * | 3/1982 | Caldwell | 108/152 |
| 4,441,619 | A | 4/1984 | Gibitz | |
| 4,502,602 | A | 3/1985 | Swanson | |
| 4,671,417 | A | 6/1987 | O'Brien | |

(Continued)

FOREIGN PATENT DOCUMENTS

| | | |
|---|---|---|
| DE | 1112265 | 8/1961 |
| FR | 586639 | 3/1925 |
| FR | 1200778 | 12/1959 |

*Primary Examiner* — Patrick Hawn
(74) *Attorney, Agent, or Firm* — Reinhart Boerner Van Deuren P.C.

(57) ABSTRACT

A retail merchandise hanger with mounting clip is provided. The retail merchandise hanger is mounted to a retail structure. Retail merchandise is hung from the retail merchandise hanger. Various improvements are disclosed including a continuously curved mounting clip that may be efficiently manufactured at a low cost, a structurally rigid base plate that is thicker than an elastically and resiliently positionable mounting clip, and a retaining tab that prevents unintentional dislodgement of the retail merchandise hanger from the retail structure.

25 Claims, 5 Drawing Sheets

(56) References Cited

U.S. PATENT DOCUMENTS

| | | | | | |
|---|---|---|---|---|---|
| 4,724,967 | A | | 2/1988 | Valiulis | |
| 4,750,698 | A | | 6/1988 | Barnes | |
| 4,762,299 | A | | 8/1988 | Langelier | |
| 4,784,199 | A | * | 11/1988 | Wise | 150/134 |
| 4,801,116 | A | | 1/1989 | Blankenship | |
| D300,003 | S | | 2/1989 | Hutchison | |
| 4,850,557 | A | | 7/1989 | Valiulis | |
| 4,860,905 | A | | 8/1989 | Schott et al. | |
| 5,035,388 | A | | 7/1991 | Nagel | |
| 5,109,993 | A | | 5/1992 | Hutchison | |
| 5,149,037 | A | * | 9/1992 | Smith | 248/216.1 |
| 5,154,304 | A | | 10/1992 | McAuley | |
| 5,154,388 | A | * | 10/1992 | Magaro | 248/248 |
| 5,163,567 | A | | 11/1992 | Betts, Sr. | |
| 5,490,650 | A | * | 2/1996 | Pendergrass | 248/220.31 |
| 5,647,566 | A | | 7/1997 | Kump | |
| 5,785,288 | A | * | 7/1998 | West | 248/220.41 |
| 6,234,436 | B1 | | 5/2001 | Kump | |
| 6,591,995 | B1 | * | 7/2003 | Grove | 211/87.01 |
| 6,698,700 | B2 | * | 3/2004 | Moerke et al. | 248/220.31 |
| 7,354,024 | B2 | * | 4/2008 | Winig et al. | 248/220.22 |

* cited by examiner

RETAIL MERCHANDISE HANGER WITH MOUNTING CLIP

FIELD INVENTION

This invention pertains generally to retail display hangers and more particularly, to rapid mount retail display hangers for use with temporary and permanent retail structures.

BACKGROUND OF THE INVENTION

For many years retail merchandise has been shipped in a condition that allows for immediate sale when unpackaged by a retailer. The retail merchandise is, in many cases, placed on retail hangers that are installed on a retail structure. The retail hangers are often affixed to the retail structure via a variety of structural configurations at an end of the hanger. An example of one such configuration is depicted in U.S. Pat. No. 4,724,967 to Valiulis and assigned to the instant assignee. Once the hangers are installed on the retail structure, retail merchandise may be hung from the hanger on a hook portion of the hanger. In many instances, the retail structure is preconfigured with the hangers to receive merchandise that is frequently depleted and subsequently replenished thereafter. Retail structures incorporating hangers, i.e. hanger type displays, therefore offer retailers the ability to very quickly restock depleted merchandise and present the same in a neat and aesthetically pleasing fashion.

In light of the above benefits of retail structures that incorporate hangers, there is a continuing desire to use them more routinely in a retail environment. Accordingly, there is a growing need to incorporate hangers in temporary retail structures, e.g. seasonal displays. Due to the temporal nature of certain retail display structures, some structures are often produced from corrugated cardboard or other light weight materials. As a result, the hangers are preferably light weight in order for the hangers to be incorporated in a structurally sound manner with the temporary retail structure. Also, due to the low cost of temporary retail structures, it is desirable to have a hanger that is also offered at a lower cost relative to other hanger designs in order to keep the overall cost of the hanger type display low. This lower cost can be achieved through rapid manufacture using cost efficient materials.

In view of the above, it is desirable to have a retail hanger that can be rapidly installed into temporary and permanent retail structures. It is further desirable that such a hanger be quickly and efficiently manufactured at a low cost. The present invention is directed toward meeting the needs described above, and is also directed toward improvements over the state of the art.

BRIEF SUMMARY OF THE INVENTION

The present invention has several aspects that may be claimed and stand as patentable independently and individually or in combination with other aspects, including but not limited to the following.

In one aspect, an embodiment of the invention provides a hanger for retail structures that can be rapidly mounted to the structure. A hanger according to this aspect comprises a base plate having front and rear surfaces, a hook extending transversally away from the front surface of the base plate, and a continuously curved mounting clip projecting from the rear surface of the base plate and extending away therefrom along a curvilinear path to at least a narrow neck region proximate a terminating end.

In another aspect, an embodiment of the invention provides a hanger for retail structures that is light enough to be incorporated into a variety of retail structures including temporary retail structures, yet structurally rigid enough to bear a typical loading of retail merchandise. A hanger for a retail display according to this aspect comprises a base plate having a thickness extending between front and rear surfaces, a hook extending transversally away from the front surface of the base plate, and a mounting clip projecting from the rear surface of the base plate and extending away therefrom, the mounting clip having a thickness that extends between an inner and an outer surface of the mounting clip, wherein the thickness of the mounting clip is less than the thickness of the base plate.

In accordance with the aspects herein, a further subsidiary feature may include a retaining tab located on the mounting clip. The retaining tab serves a safety function by preventing the hanger from becoming unintentionally dislodged from the retail structure. The retaining tab also may provide a land or a flat surface that is struck by an ejector pin in the event an injection molding process is utilized in the manufacture of the hanger.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
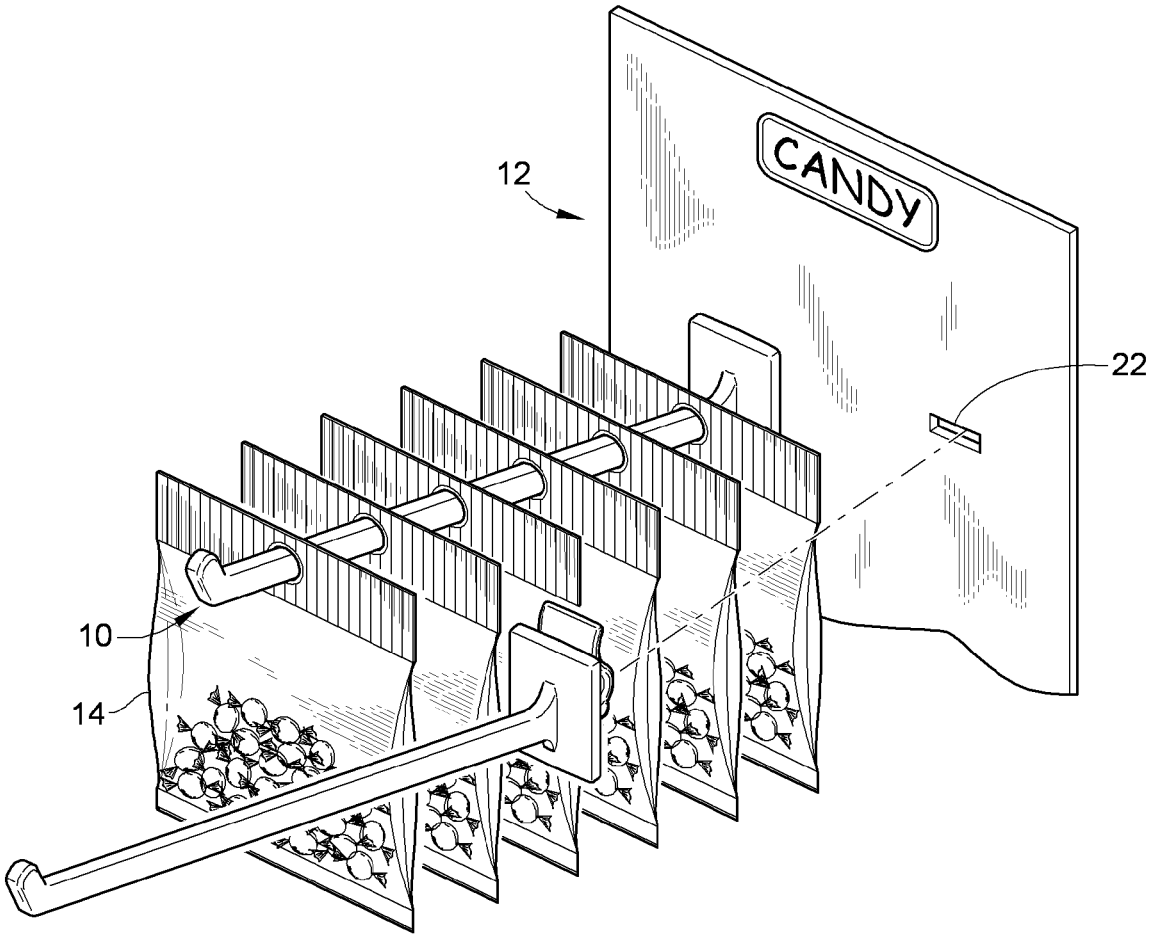
FIG. 1 is a perspective view of an exemplary embodiment of a retail merchandise hanger with a mounting clip installed upon a retail structure.

Referring to FIG. 1, a hanger 10 is illustrated installed in a display structure 12. Retail merchandise 14 is suspended from the hanger 10. The hanger 10 is received by the retail structure 12 through a horizontal opening 22. A variety of retail merchandise 14 may be hung from the hanger 10, including but not limited to packaged goods, snack foods, and other similarly sized goods. The retail structure 12 may be a permanent display structure, or a more temporary structure, for example, a corrugated cardboard display.

Figure 2:
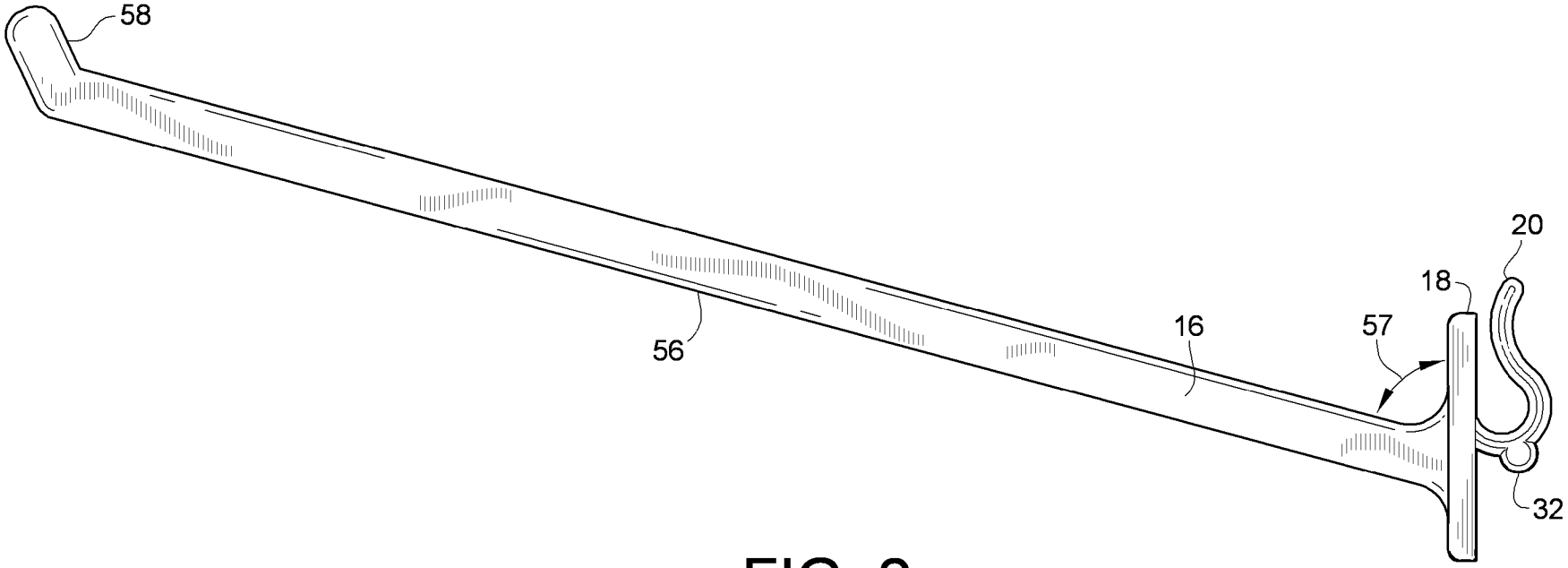
FIG. 2 is a side view of the hanger of FIG. 1.

Referring to FIG. 2, an exemplary embodiment of the hanger 10 is illustrated comprising a hook 16, a base plate 18, and a mounting clip 20. The hanger 10 may be formed from a molded plastic or similar structurally rigid material. Although illustrated as unitarily formed, the hook 16, base plate 18 and mounting clip 20 may be manufactured separately and mechanically affixed to one another using a variety of methods in accordance with the description herein.

Figure 3:
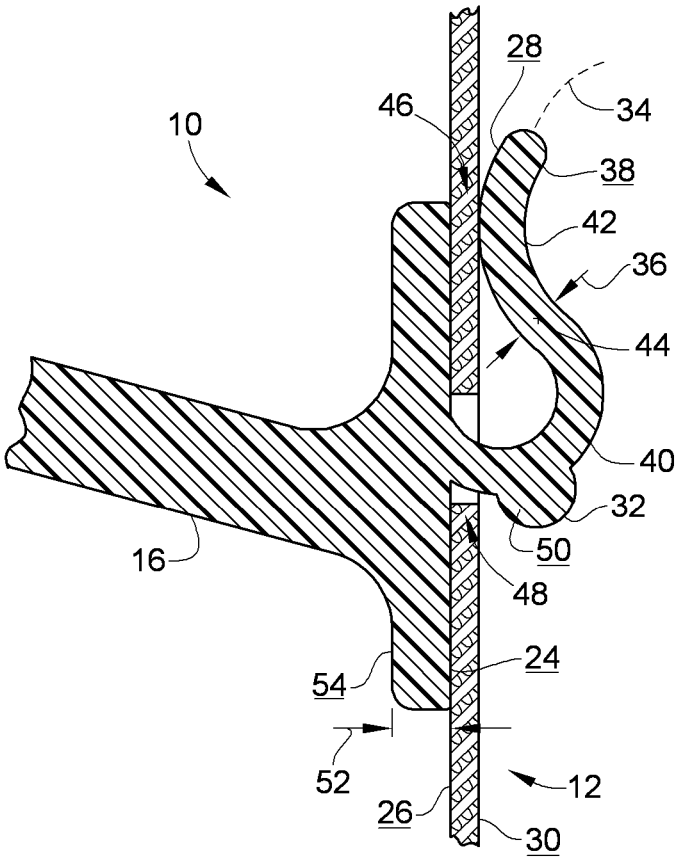
FIG. 3 is a side sectional view of the hanger of FIG. 1 installed on the retail structure of FIG. 1.

Referring simultaneously to FIGS. 1, 2 and 3 the hanger 10 is affixed to the retail structure 12 by sliding the mounting clip 20 through the horizontal opening 22. With reference to FIG. 3, a rear surface 24 of the base plate is in surface contact with a front surface 26 of the retail structure 12 and an inner surface 28 of the mounting clip 20 is in surface contact with a rear surface 30 of the retail structure 12 when the hanger 10 is fully installed. As illustrated in FIG. 3, the mounting clip 20 and base plate 18 cooperatively compress the retail structure 12 when the hanger 10 is fully installed thereon, and thereby hold the hanger 10 operably in place upon the retail structure 12. As will be discussed in greater detail below, the mounting clip 20 possesses a spring like resiliency, and allows the user to elastically displace the mounting clip to receive, and thereafter exert positive compressive pressure upon, a portion of the retail structure 12. Additionally, a retaining tab 32 may also make contact with the rear surface of the retail structure 12, thereby further preventing the hanger 10 from becoming unintentionally dislodged from the retail structure 12.

Referring now to FIG. 3, the mounting clip 20 is illustrated as having a generally continuously curved profile. The mounting clip 20 extends away from the rear surface 24 of the base plate 18 along a curvilinear path 34. As such, the mounting clip 20, when viewed from the side, generally resembles a "S" shape. The mounting clip 20 has a thickness 36 which extends between inner and outer surfaces 28, 38 of the mounting clip 20. Additionally and as noted above, the mounting clip 20 may also include a retaining tab 32 projecting generally downward and away from the mounting clip 20. The thickness 36 of the mounting clip 20 may range between about 0.75" and about 0.125", but can also deviate from this range in other embodiments. The overall width of the mounting clip 20 may range between about 0.25" to about 5", but may deviate from this range in other embodiments. In one embodiment, the overall width and thickness 36 of the mounting clip 20 is sized so as to leave an area of clearance between horizontal opening 22 of FIG. 1 and the mounting clip 20. In such an embodiment, the mounting clip 20 is quickly and easily installed upon the retail structure 12 (see FIG. 1) without any sliding friction between the retail structure 12 and the mounting clip 20.

Figure 5:
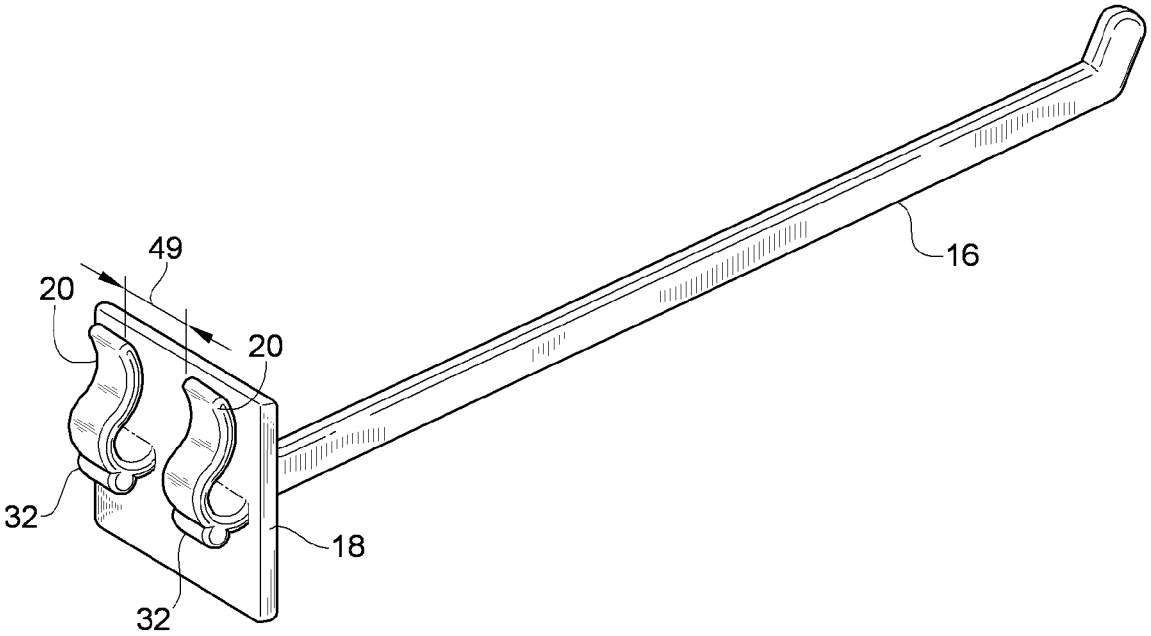
FIG. 5 is a perspective view of an exemplary embodiment of a retail merchandise hanger with multiple mounting clips.

Turning now to FIG. 5, an alternative embodiment of the hanger 10 is illustrated wherein multiple mounting clips 20 extend away from the base plate 18. Where multiple mounting clips 20 are utilized, each may extend away from the base plate 18 along a curvilinear path 34 (see FIG. 2). In the illustrated embodiment, the mounting clips 20 are spaced apart by a distance 49. Just as in the single mounting clip 20 embodiment, the mounting clips 20 of the multi-clip embodiment each possess a spring like resiliency, allowing the user to elastically displace them relative to the base plate 18 in order to mount the hanger 10 to the retail structure 12 (see FIG. 1).

The curvilinear path 34 of the mounting clip 20 functions to provide a spring like tension between the mounting clip 20 and base plate 18. The curvilinear path 34, i.e. shape, of the mounting clip 20 also provides a simplified shape for ease in manufacturing. By design, there are minimal stress concentrations on the mounting clip 20 because the mounting clip 20 follows a generally curvilinear path 34 as opposed to a path having abrupt directional changes, e.g. right angles, thereby making the mounting clip 20 more robust and resistant to stress fracture. Additionally, and discussed in greater detail below, the curvilinear path 34 facilitates rapid installation of the hanger 10, by allowing the user to affix the hanger 10 to a retail structure 12 using a series of simple motions.

As illustrated, the curvilinear path 34 includes a concave portion 40 and a convex portion 42 separated at an inflection point 44. The concave portion 40 is concave relative to the rear surface 24 of the base plate 18. Likewise, the convex portion 42 is convex relative to the rear surface 24 of the base plate 18. The convex portion 42 and the rear surface 24 of the base plate 18 may be spaced apart by a narrowed neck region in the form of a slight gap 46. The gap 46 facilitates quick installation of the hanger 10 to the retail structure 12 by allowing a portion of the retail structure 12 to slide easily through the gap 46. However, the gap 46 is sized such that the mounting clip 20 and base plate 18 can exert a sufficient amount of compressive force against the retail structure 12 to hold the hanger 10 in place when it is fully installed. Although illustrated as using gap 46, in other embodiments, the hanger 10 may be supplied without the gap 46. In such an embodiment, the convex portion 42 is in tangential contact with the rear surface 24 of the base plate 18. The concave portion 40 may be defined by a radius taken at the inner surface 28 of the mounting clip 20 of between about 0.1" to about 1", but can deviate from this range in other embodiments. Similarly, the convex portion 42 may be defined along a radius taken at the outer surface 38 of the mounting clip 20 of between about 0.2" to about 2", but can deviate from this range in other embodiments.

Still referring to FIG. 3, as noted above, the concave and convex portions 40, 42 are separated by a single point of inflection 44. As can be seen in the illustrated embodiment, there are no straight portions between the concave and convex portions 40, 42. The mounting clip 20 therefore transitions from possessing a concave shape to a convex shape immediately at the point of inflection 44, and is therefore continuously curved. However, in other embodiments, the concave and convex portions 40, 42 are separated by an inflection region as opposed to a single inflection point 44. In such an embodiment, the concave portion 40 transitions into the convex portion 42 over a length of the mounting clip 20.

The concave portion 40 may be supplied with a radius that is equal to the radius defining the convex portion 42 or possess a radius that is different in size from the radius defining the convex portion 42. In either case, the concave portion 40 allows the mounting clip 20 to possess a generally spring-like resiliency. As a result, the mounting clip 20 may be bent away from the base plate 18 in an elastic manner in order to be easily installed upon the retail structure 12. As illustrated, the concave portion 40 is incident to the base plate 18 tangentially at a generally oblique angle.

The retaining tab 32 extends transversely away from the outer surface 38 of the mounting clip 20 at the concave portion 40. As illustrated in FIG. 3, when fully installed, the retaining tab 32 prevents the hanger 10 from becoming unintentionally dislodged from the retail structure 12. The retaining tab 32 accomplishes this by preventing free sliding of the mounting clip 20 within the horizontal opening 22. More particularly, the retaining tab 32 prevents free sliding motion relative to the horizontal opening 22 by engaging a portion of the retail structure 12 contained in a gap 48 between the retaining tab 32 and the rear surface 24 of the base plate 18. During an unintentional dislodgement event, the mounting clip 20 will slide within the horizontal opening 22 until the retaining tab 32 engages the rear surface 30 of the retail structure 12 located within the gap 48.

The retaining tab 32 may also incorporate a flat surface 50 at an end of the retaining tab 32. The flat surface 50 may be used as a land or striking point of an ejector pin where an injection molding process is utilized in the manufacture of hanger 10. Additionally, the flat 50 of the retaining tab 32 may be stamped or otherwise marked during the injection molding process with an ejector pin that has an extruded stamp or marking. Although illustrated as having a generally cylindrical shape, the retaining tab 32 may possess other similar geometrical profiles.

Still referring to FIG. 3, as noted above the base plate 18 functions in combination with the mounting clip 20 to supply sufficient compressive force against the retail structure 12 to hold the hanger 10 in place. The base plate 18 has a thickness 52 that extends between a front surface 54 of the base plate 18 and the rear surface 24 of the base plate 18. The sides of the base plate 18 may be flat in order to facilitate stamping or marking of the base plate 18. The thickness 52 of the base plate 18 may be the same as, or different from, the thickness 36 of the mounting clip 20. In one embodiment, the thickness 52 of the base plate is greater than the thickness 36 of the mounting clip 20 so that the base plate 18 functions to reinforce the hanger 10 against the retail structure 12, while the mounting clip 20 functions to allow for resilient and elastic displacement during mounting. The base plate 18 may have a generally rectangular shape, or in the alternative, have any other geometric shape sufficient to provide enough bearing pressure against the retail structure 12 when the hanger 10 is installed thereon. The overall width of the base plate 18 may be the same as or different from the width of the mounting clip 20. In one embodiment, the base plate 18 may have a width and a height of between about 0.5" to 6", but can deviate from this range in other embodiments. The thickness 52 of the base plate 18 may be between about 0.1" and about 1", but may deviate from this range in other embodiments.

Referring back to FIG. 2 the hook 16 is illustrated with a straight portion 56 and bent or otherwise interrupted portion in the form of a retainer 58. As illustrated in FIG. 2, the hook 16 extends generally transversely away from the base plate 18. In the illustrated embodiment, the hook 16 extends away from the base plate 18 at an angle 57. In one embodiment, the angle 57 is less than 90°. In such an embodiment, the retail merchandise 14 of FIG. 1 is biased by gravity towards the base plate 18, and thereby prevented from accidentally falling off of the hook 16.

Still referring to FIG. 2, the retainer 58 extends angularly away from the straight portion 56, and is functionally similar to the angle 57 of the hook 16 with respect to the base plate 18 in that the retainer 58 also prevents merchandise 14 from accidentally falling off the hook 16. Although illustrated as incorporating a retainer 58, the hook 16 may be supplied without a retainer 58 entirely, and therefore possess only a continuous straight portion 56. Also the hook 16 may possess a variety of cross sectional profiles. The cross sectional profile of the hook 16 may be geometrically regular or geometrically irregular depending upon the application. The hook may have an overall length of between about 1.5" and about 8", but may deviate from this range in other embodiments.

Having discussed the structural attributes of several embodiments of the hanger 10 the remainder of the description will now describe how the hanger 10 is installed to the retail structure 12.

Figure 4:
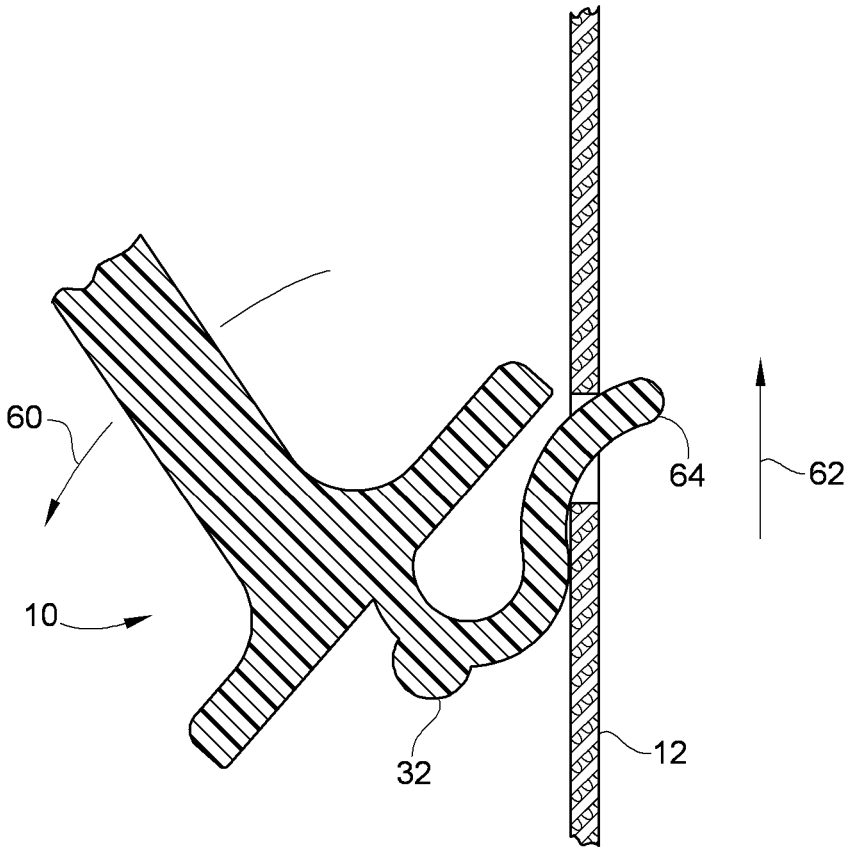
FIG. 4 is a side sectional view of the general installation of the hanger of FIG. 1 to the retail structure of FIG. 1.

Referring now to FIG. 4, the hanger 10 may be installed upon the retail structure 12 by first aligning a terminating end 64 of the mounting clip 20 with the horizontal opening 22 of the retail structure 12. The hanger 10 is then rotated along angular direction 60, generally following the curvilinear path 34 of the mounting clip 20 until the mounting clip 20 and retaining tab 32 have fully passed through the horizontal opening 22. The hanger 10 is then vertically positioned along linear direction line 62 so that the retail structure 12 is in a generally compressed state within the gap 46 between the mounting clip 20 and the base plate 18. However, as noted above, in other embodiments the hanger 10 may be supplied without the gap 46. As such, the mounting clip 20 will resiliently deform away from the base plate 18 in a greater amount than it would in an embodiment of the hanger 10 that does incorporate a gap 46. In either case, the mounting clip 20 is resilient enough to allow the retail structure 12 to be compressed between the inner surface 28 of the mounting clip 20 and the rear surface 24 of the base plate 18.

Once the hanger 10 is fully installed on the retail structure 12, retail merchandise may be situated upon the hook 16. To uninstall the hanger 10 from the retail structure 12 a reverse process is followed. First, all retail merchandise 14 is removed from the hook 16. Then, the hanger 10 is moved downward along linear direction line 62. Finally the hanger 10 is rotated clockwise along angular direction line 60 and generally following curvilinear path 34 such that the mounting clip 20 and retaining tab 32 have fully passed through the horizontal opening 22. As described above, the hanger 10 can be rapidly installed via simple process of limited manipulation, due in part to the curvilinear path 34 followed by the mounting clip 20.

As described herein, the retail merchandise hanger 10 provides a low cost and lightweight solution to utilizing a hanger type display in a variety of retail environments. Additionally, when retaining tab 32 is incorporated, the hanger 10 provides a robust fail safe against the unintentional dislodgement thereof.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hanger for a retail structure, comprising:

a base plate having front and rear surfaces;

a hook extending transversely away from the front surface of the base plate; and a continuously curved mounting clip projecting from the rear surface of the base plate along a curvilinear path to at least a narrow neck region proximate a terminating end.

2. The hanger of claim 1 wherein the continuously curved mounting clip projects from the rear surface of the base plate along the curvilinear path past the narrow neck region and to the terminating end.

3. The hanger of claim 1 wherein the mounting clip comprises a concave portion and a convex portion, the concave portion projecting from the rear surface of the base plate and terminating at a point of inflection, the convex portion beginning at the point of inflection and extending to the terminating end of the mounting clip, wherein the concave portion is concave relative to the rear surface of the base plate, and the convex portion is convex relative to the rear surface of the base plate, and wherein the mounting clip has a thickness extending between an inner and an outer surface of the mounting clip.

4. The hanger of claim 3 wherein the thickness and a width of the mounting clip are constant along the curvilinear path of the mounting clip.

5. The hanger of claim 3 wherein at least a portion of the inner surface of the mounting clip and the rear surface of the base plate are in generally tangential contact at the narrow neck region.

6. The hanger of claim 3 wherein the convex portion is generally above the concave portion of the mounting clip, and wherein the inner surface of the mounting clip and the rear surface of the base plate are in engageable contact with a rear surface and a front surface respectively of the retail structure.

7. The hanger of claim 3 further comprising a retaining tab projecting away from the outer surface of the mounting clip.

8. The hanger of claim 7 wherein the retaining tab projects away from the outer surface of the mounting clip at the concave portion, wherein the retaining tab and the rear surface of the base plate cooperatively define a gap, and wherein a portion of the retail structure is interposed within the gap between the retaining tab and the rear surface of the base plate when the hanger is in a mounted state.

9. The hanger of claim 7 wherein the retaining tab has a generally circular profile, and at least one flat sided end.

10. The hanger of claim 3 wherein the base plate has a thickness extending between the front and rear surfaces, and the thickness of the base plate is greater than the thickness of the mounting clip.

11. The hanger of claim 1 wherein the base plate, hook, and mounting clip are a unitarily formed plastic structure.

12. A hanger for a retail structure, comprising:

a base plate having a thickness extending between front and rear surfaces;

a hook extending transversely away from the front surface of the base plate;

a mounting clip projecting away from the rear surface of the base plate, the mounting clip having a thickness that extends between an inner and an outer surface of the mounting clip, wherein the thickness of the mounting clip is less than the thickness of the base plate; wherein the mounting clip is curved, and comprises a concave portion and a convex portion, the concave portion projecting from the rear surface of the base plate and terminating at a point of inflection, the convex portion beginning at the point of inflection and extending to a terminating end of the mounting clip, wherein the concave portion is concave relative to the rear surface of the base plate, and the convex portion is convex relative to the rear surface of the base plate, and wherein the mounting clip has a thickness extending between an inner and an outer surface of the mounting clip.

13. The hanger of claim 12 further comprising a retaining tab projecting generally downward and transversely away from the outer surface of the mounting clip.

14. The hanger of claim 13 wherein the hanger has a relaxed unmounted state and a mounted state, and the retail structure has a wall with at least one horizontal rectangular aperture passing therethrough, the wall extending between a front and a rear surface, wherein in the mounted state the mounting clip extends through the at least one horizontal rectangular aperture and engages the rear surface of the wall and the retaining tab is positioned to engage the rear surface of the wall to prevent dislodging.

15. The hanger of claim 13 wherein the retaining tab has a generally circular profile, and at least one flat sided end.

16. The hanger of claim 12 wherein the base plate has at least one flat side.

17. The hanger of claim 12 wherein the base plate, hook, and mounting clip are a unitarily formed plastic structure.

18. A hanger for a retail structure, comprising:

a base plate having a thickness extending between front and rear surfaces;

a hook extending transversely away from the front surface of the base plate;

a mounting clip projecting away from the rear surface of the base plate, the mounting clip having an inflection arrangement, including a first concave segment, and a second convex segment on opposing sides of an inflection region.

19. The hanger of claim 18 wherein the inflection region is an inflection point, and wherein the first concave segment transitions immediately into the second convex segment at the inflection point.

20. The hanger of claim 19 wherein the mounting clip is continuously curved and projects away from the rear surface of the base plate along a curvilinear path.

21. The hanger of claim 18 wherein the mounting clip has a thickness that extends between inner and outer surfaces of the mounting clip, and wherein the base plate thickness is greater than the mounting clip thickness.

22. The hanger of claim 21 wherein a retaining tab extends away from the outer surface of the mounting clip at the first concave segment.

23. The hanger of claim 18 wherein the base plate, hook, and mounting clip are a unitarily formed plastic structure.

24. The hanger of claim 7 wherein the hanger has a relaxed unmounted state and a mounted state, and the retail structure has a wall with at least one horizontal rectangular aperture passing therethrough, the wall extending between a front and a rear surface, wherein in the mounted state the mounting clip extends through the at least one horizontal rectangular aperture and engages the rear surface of the wall and the retaining tab is positioned to engage the rear surface of the wall to prevent dislodging.

25. The hanger of claim 22 wherein the hanger has a relaxed unmounted state and a mounted state, and the retail structure has a wall with at least one horizontal rectangular aperture passing therethrough, the wall extending between a front and a rear surface, wherein in the mounted state the mounting clip extends through the at least one horizontal rectangular aperture and engages the rear surface of the wall and the retaining tab is positioned to engage the rear surface of the wall to prevent dislodging.

* * * * *